US011318735B2

(12) United States Patent
Sanz Ananos et al.

(10) Patent No.: US 11,318,735 B2
(45) Date of Patent: May 3, 2022

(54) PREVENTING PRINTING ERRORS DUE TO PRINT MEDIA DEFORMATIONS

(71) Applicant: HEWLETT-PACKARD DEVELOPMENT COMPANY, L.P., Spring, TX (US)

(72) Inventors: Santiago Sanz Ananos, Sant Cugat del Valles (ES); Juan Uroz, Terrassa (ES); Eduardo Amela Conesa, Sant Cugat del Valles (ES); Francisco Lopez Moral, Sant Cugat del Valles (ES); Marta Blanch Pinol, Sant Cugat del Valles (ES); Diana Canto Estany, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/493,023

(22) PCT Filed: Jun. 18, 2018

(86) PCT No.: PCT/US2018/038101
§ 371 (c)(1),
(2) Date: Sep. 11, 2019

(87) PCT Pub. No.: WO2019/245523
PCT Pub. Date: Dec. 26, 2019

(65) Prior Publication Data

US 2021/0362514 A1 Nov. 25, 2021

(51) Int. Cl.

| | |
|---|---|
| ***B41J 2/045*** | (2006.01) |
| ***B41J 11/00*** | (2006.01) |
| ***B41J 13/00*** | (2006.01) |

(52) U.S. Cl.
CPC ..... *B41J 2/04508* (2013.01); *B41J 2/04526* (2013.01); *B41J 2/04536* (2013.01);
(Continued)

(58) Field of Classification Search
CPC ..... B41J 2/04508; B41J 2/04526; B41J 2/04536; B41J 2/04541; B41J 2/04556;
(Continued)

(56) References Cited

U.S. PATENT DOCUMENTS

| | | | |
|---|---|---|---|
| 8,419,144 | B2 | 4/2013 | Castillo et al. |
| 8,708,450 | B2 | 4/2014 | Li et al. |

(Continued)

FOREIGN PATENT DOCUMENTS

| | | | |
|---|---|---|---|
| CN | 107379761 | A | 11/2017 |
| EP | 0823978 | B1 | 2/1998 |
| WO | WO2016055501 | A1 | 4/2016 |

*Primary Examiner* — Matthew Luu
*Assistant Examiner* — Kendrick X Liu
(74) *Attorney, Agent, or Firm* — HP Inc. Patent Department

(57) ABSTRACT

Method and devices for dynamically preventing printing errors caused by a media deformation are disclosed. In one example, a pen to print media space (PPS) distance is measured. A media deformation is identified in response to measuring the PPS distance. A corrective function is identified in response to identifying the media deformation. The corrective function identified is then performed. The proposed method provides for consistent quality across a print.

20 Claims, 5 Drawing Sheets

Fig. 2C

(52) U.S. Cl.
CPC ..... *B41J 2/04541* (2013.01); *B41J 2/04556* (2013.01); *B41J 2/04573* (2013.01); *B41J 2/04586* (2013.01); *B41J 11/002* (2013.01); *B41J 11/0005* (2013.01); *B41J 11/0035* (2013.01); *B41J 11/0095* (2013.01); *B41J 11/00212* (2021.01); *B41J 13/0027* (2013.01)

(58) Field of Classification Search
CPC .. B41J 2/04573; B41J 11/002; B41J 11/0035; B41J 13/0027
See application file for complete search history.

(56) References Cited

U.S. PATENT DOCUMENTS

| | | | | |
|---|---|---|---|---|
| 8,746,694 | B2 | 6/2014 | Moore et al. | |
| 8,864,393 | B2 | 10/2014 | Castells et al. | |
| 9,428,360 | B2 | 8/2016 | Herrmann et al. | |
| 9,545,790 | B2 * | 1/2017 | Gracia Verdugo ... | B41J 11/0095 |
| 2004/0217999 | A1 | 11/2004 | Boleda et al. | |
| 2005/0088469 | A1 * | 4/2005 | Igarashi ..... | B41J 2/04586 347/14 |
| 2008/0024531 | A1 | 1/2008 | Bastani et al. | |
| 2009/0057997 | A1 * | 3/2009 | Hatada ..... | B41J 13/0009 271/270 |
| 2012/0127248 | A1 * | 5/2012 | Koganehira ..... | B41J 2/2114 347/102 |
| 2013/0293605 | A1 | 11/2013 | Bar-Tai et al. | |
| 2018/0086108 | A1 | 3/2018 | Hojo | |

* cited by examiner

PREVENTING PRINTING ERRORS DUE TO PRINT MEDIA DEFORMATIONS

BACKGROUND

Digital printing involves technologies in which a printed image is created from digital data, also known as two dimensional (2D) printing, and technologies where material is selectively solidified with the aid of printing fluids ejected from printheads on a bed of build materials, also known as three dimensional (3D) printing. Known methods of digital printing include full-color ink-jet, electrophotographic printing, laser photo printing, thermal transfer printing methods, plastic fused deposition modelling, material jetting and stereolithography. In some printing methods, a pen or printhead is mounted on a printhead support. Print media is guided on a print media support structure, also called a "platen". The printhead ejects printing fluid, e.g. through nozzles, in a printing space defined between the printhead and the print media. In electrophotographic printing methods, i.e. the printing process used in many laser printers and other such electro-photographic printers, the process involves creating a latent electrostatic image on a photoconductor and depositing toner on the surface of the photoconductor. The toner adheres to the imaged areas of the photoconductor to form a developed image that is transferred to paper or another print substrate or media.

BRIEF DESCRIPTION OF THE DRAWINGS

Various example features will be apparent from the detailed description which follows, taken in conjunction with the accompanying drawings, wherein.

DETAILED DESCRIPTION

Figure 1:
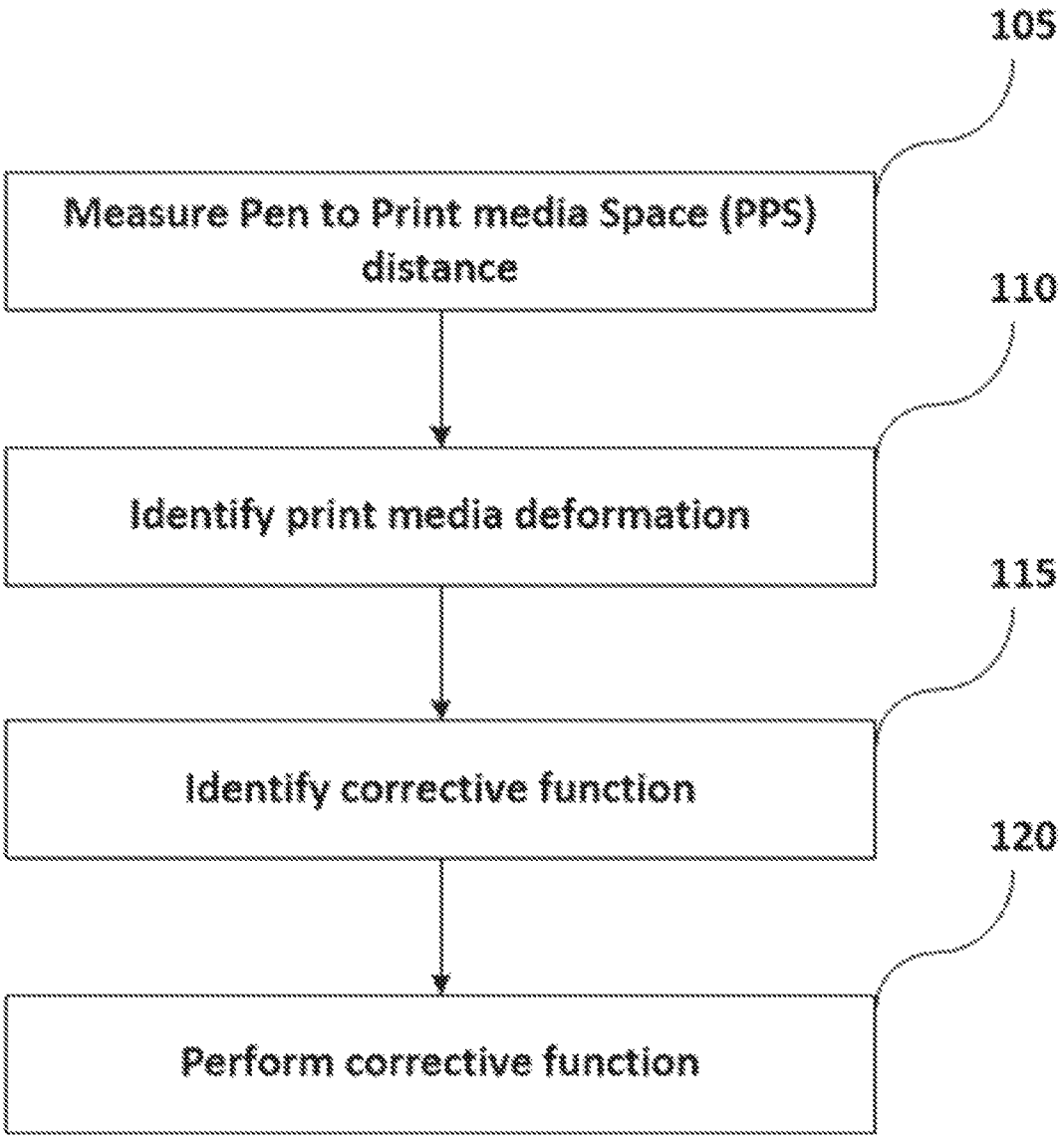
FIG. 1 is a flow diagram of a method of dynamically preventing printing errors caused by a media deformation.

The distance between a printhead and the print media is called pen-to-print media space (PPS) distance or pen-to-paper distance. PPS distance affects the final printing quality due to several aspects, e.g. the aerosol effect or the final position of the drop of print fluid, e.g. ink, onto the print media. For many print jobs a theoretical PPS is used based on print media type when performing a print job.

Some printers may be used unattended in a continuous manner. The up time of the printer may be a critical factor. Unattended printing allows for example for overnight printing, without operators supervision. In order to improve unattended up time, detecting a problem before it happens and giving the printers capabilities to solve the problems is a key factor.

For example, in printers capable of printing in rigid media, the variety of different print media with different thickness may be very wide. Some printers may be able to print from paper to doors or other rigid materials with a thickness of up to 50 mm.

To print in such a variety of thickness, the printer carriage may be attached to a vertically moveable beam to adapt the (PPS) to the media or media type that is being loaded.

As the printer may print in a variety of print media, the user may have a storage area to store all the rigid material that may be available. Depending on the type of material and the time that has been stored, the rigid material may be deformed due to storage conditions, e.g. high temperature or high humidity. For example, hygroscopic materials, may be affected by ambient humidity and changes in temperature that may influence their weight, thickness, and rigidity. This effect may occur for example in corrugated cartons or plastic materials.

In other printers, e.g. bidirectional latex printers using aqueous fluids, high temperatures may be used to dry the aqueous fluids in the print-zone and to cure to polymerize the latex. Many of the rigid solid plastic substrates may then suffer a deformation in the print zone, causing undesired artifacts in the image quality due to bidirectional correction inaccuracies. As this may happen dynamically, it is sometimes difficult to predict and correct.

In latex printers, media crashes may happen while printing. As in some latex printer models there is an Infrared (IR) lamp attached to the carriage, a fire condition may happen, and damage to the printheads may be caused.

The fire risk may be present because power is applied to evaporate the water from the print fluid or ink, and to cure the latex inks. Thus, if the print media remains close to a heat source for over a predetermined amount of time, it may burn or catch fire. In such cases, crash sensors may be triggered and the printer may disable the power of the printer and ask the user to remove the cause of the crash.

If the media crash has been severe, and the carriage has not been able to stop before the carriage actually crashes with the media, some of the printheads may need to be replaced after the printer boots up again and checks the status of the printheads.

Another consequence of the triggering of the crash sensors is a system error in the printer, and the need of a user or operator intervention.

There are several types of deformations that may cause a printer to malfunction or reduce the quality of a print job and, therefore, need to be identified, Examples of such types of deformations may be media thickness variations, media bending, media wrinkling, media imperfections or the like.

As heat is applied to dry and cure the ink, the media may be heated. Depending on characteristics of the media and of the ambient temperature, the media may start to bend. This effect may be more prominent for example in plastic rigid medias.

Wrinkles may appear when there are problems with media advance. It is more frequent on flexible media.

Media deformations may thus be associated with a discrepancy between theoretical PPS and real PPS. Detecting early and mitigating these media deformations may extend the up time of a printer and may reduce image quality errors, printing errors, media crashes and damage conditions to the print media and/or to the printheads.

FIG. 1 is a flow diagram of a method of dynamically preventing printing errors caused by a media deformation. In block 105, a pen to print media space (PPS) distance may be measured. One or more PPS distances may be measured. For example, while a print media is advancing, e.g. in a stop-and-forward type printer, the PPS distance may be sampled at each stop point. Such measurements may be performed by a PPS detector, e.g. by an inline PPS detector mounted on the same carriage as the printhead or on a separate inline carriage. In block 110, a media deformation may be identified in response to the PPS distance measurement. Such media deformation may include, among others: a print media thickness deformation, e.g. a thickening of the print media caused e.g. by heat or humidity; a folding or wrinkle in the print media; or a print media bending. In block 115, in response to the media malfunction identified, a corrective function or routine may be identified and selected. For example, in case of a print media thickness deformation caused by heat, the corrective function may be to decrease the heat and/or modify the speed of the print media. In block 120 the identified corrective function or routine may be performed. Performing the corrective function may mitigate the media deformation or the effect of the media deformation. For example, if the media deformation is permanent, e.g. if the thickness of the print media has changed permanently due to heat, then the corrective function may include a further movement of the platen to reestablish the PPS based on the measured PPS and not based on the theoretical PPS according to the print media type. If a print media deformation in the form of wrinkles has taken place the corrective function may include performing a reciprocating movement of the print media to mitigate the wrinkling of the print media. If the print media deformation is debited to the drying and/or curing temperature of the print media the corrective function may include reducing the draying and/or curing temperature of the print media. If the print media deformation causes an image quality issue, e.g. blurring because of wrong landing of fired ink drops in bidirectional printing, then the corrective function may include adding a delay to the firing of the ink drops to account for the measured PPS compared to the theoretical PPS.

Figure 2A:
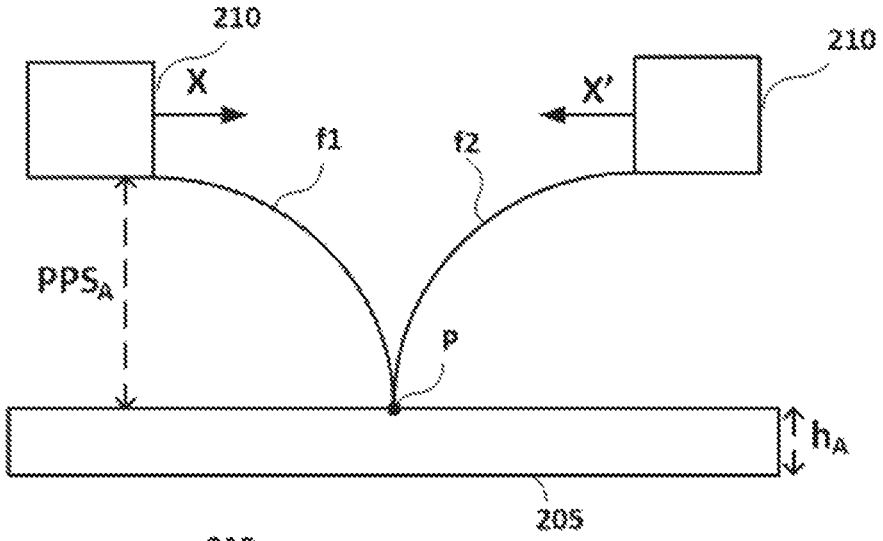
FIGS. 2A, 2B and 2C schematically illustrate an image quality correction scenario.
Figure 2B:
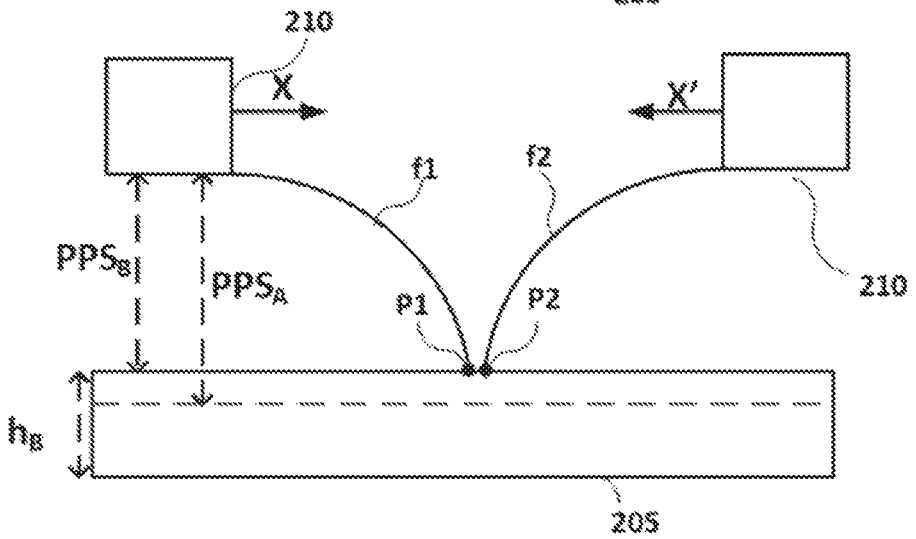
Figure 2C:
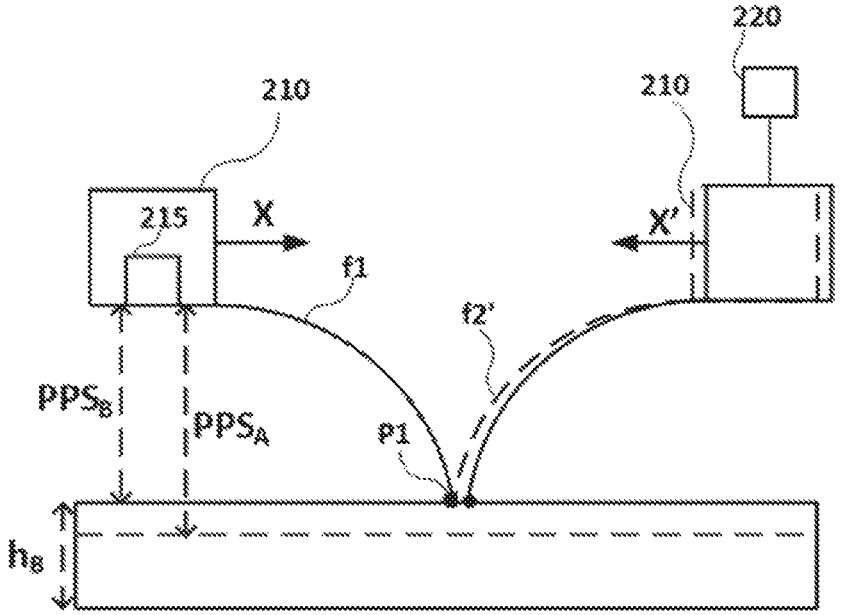

FIGS. 2A, 2B and 2C schematically illustrate an image quality correction scenario. In FIG. 2A a media with a theoretical thickness or height $h_A$ may be loaded in a printer resulting in a theoretical PPS ($PPS_A$) matching the real PPS. In FIG. 2A no print media deformation takes place and no preventing or corrective mechanism is installed. The printer may comprise a printhead 210 and may execute a firing sequence in a bidirectional manner. That is, the printhead 210 may fire a drop f1 in direction X and another drop f2 in direction X', whereby direction X' may be opposite to the direction X. The two drops, when the theoretical PPS matches the real PPS may coincide on a desired impact point P on the print media 205. Thus no image defects may be perceived. In FIG. 2B, the print media may be deformed, resulting in a media thickness or height $h_B$, where $h_B > h_A$. This height difference may result in a PPS difference. That is, the real PPS ($PPS_B$) may be shorter than the theoretical PPS ($PPS_A$). Without any intervention, the firing f1 may then fall on P1, short of the theoretical impact point P, and the same may happen with the firing f2 falling on P2. Thus an image blur may occur. In FIG. 2C, the real PPS ($PPS_B$) may be measured using a PPS detector 215 and then a delay may be applied to the firing of ink drops f1 and/or f2. For example, the firing of f2 may be delayed by a delay circuit 220 resulting in a firing f2', a calculated delay time, e.g. a few milliseconds, after the theoretical firing 2. The firing delay may result in a coincidence of the two firing drops on the desired impact point. In the example of FIG. 2C, the firing drops f1 and f2' may coincide on P1. In other examples, a delay may be introduced in the firing of both f1 and f2 thus achieving the theoretical target or impact point P.

Figure 3:
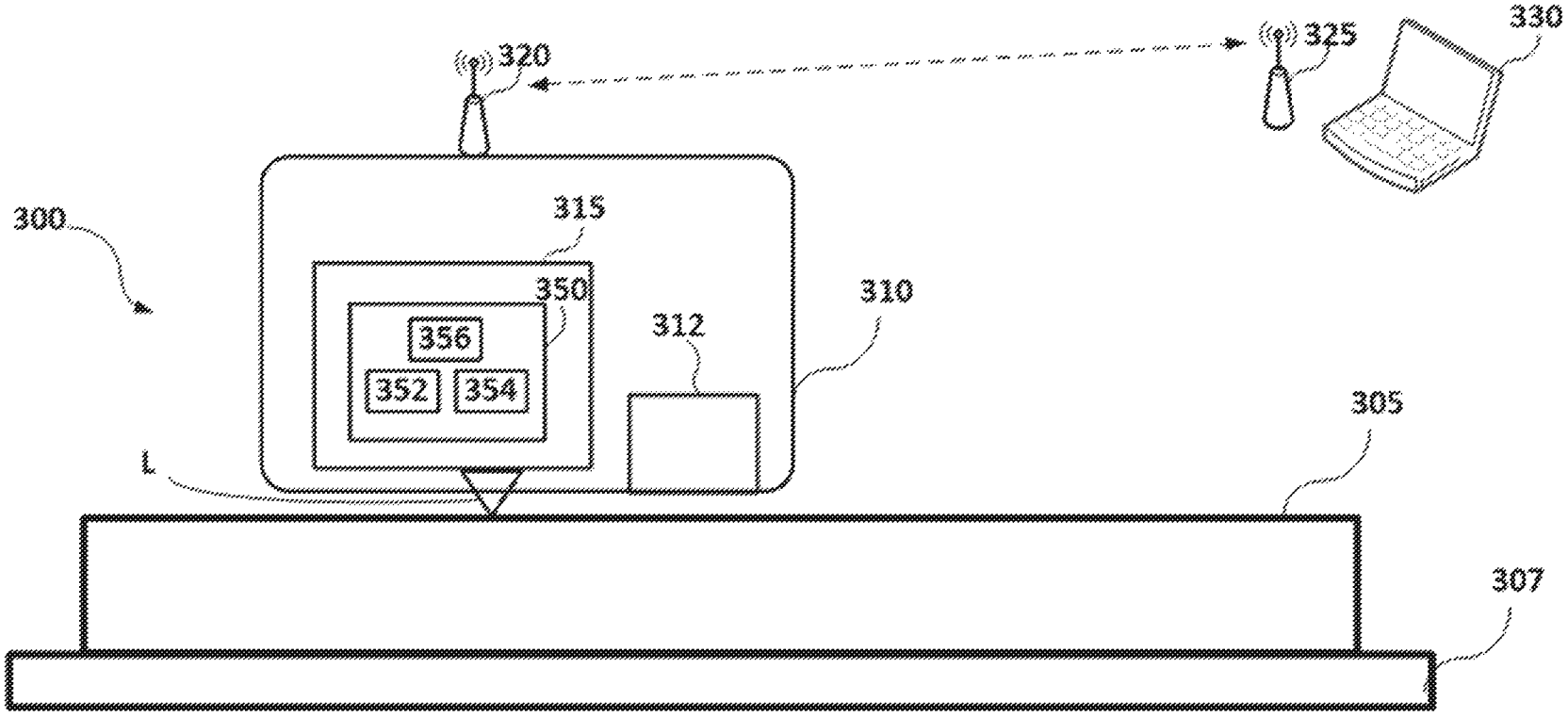
FIG. 3 schematically illustrates a printing system according to an example.

FIG. 3 schematically illustrates a printing system according to an example. Printing system 300 may comprise a print carriage 310 moveable over a platen 307. A print media 305 may be loaded on the platen 307. The print carriage 310 may comprise a printhead 312 and a PPS detector 315. The PPS detector 315 may measure PPS using, e.g. a laser beam L. The PPS detector 315 may comprise a controller 350. The controller 350 may be hosted in the PPS detector 315 or may be remote and comprise a communication channel to communicate to the PPS detector 315. The controller 350 may include a processor 352, a data storage 354 coupled to the processor and an instruction set 356. The instruction set 356 may cooperate with the processor 352 and the data storage 354 to receive measurements from the PPS detector and perform calculations to determine PPS distance between the PPS detector 315 and the print media once the PPS detector 315 is mounted on printer 300. In the example, instruction set 356 comprises executable instructions for the processor 352, the executable instructions being encoded in data storage 354. Instruction set 356 cooperates with the processor 352 and data storage 354 to receive the measurements from the PPS detector 315 and perform the PPS distance calculations. Data storage may include any electronic, magnetic, optical, or other physical storage device that stores executable instructions. In an example, controller 350 is an electronic controller which communicates with the printer. In an example, the controller is an electronic controller which comprises a processor 352 and a memory or data storage 354 and possibly other electronic circuits for communication including receiving and sending electronic input and output signals. An example electronic controller may receive data from a host system, such as a computer, and may include memory for temporarily storing data. Data may be sent to an electronic controller along an electronic, infrared, optical or other information transfer path. The processor 352 may perform operations on data. In an example, the processor is an application specific processor, for example a processor dedicated to PPS measurement. The processor may also be a central processing unit. In an example, the processor comprises an electronic logic circuit or core and a plurality of input and output pins for transmitting and receiving data. Data storage 354 may include any electronic, magnetic, optical, or other physical storage device that stores executable instructions. Data storage 229 may be, for example, Random Access Memory (RAM), an Electrically-Erasable Programmable Read-Only Memory (EEPROM), a storage drive, an optical disk, and the like. Data storage 229 is coupled to the processor 227. The controller 350 may control the function, e.g. firing sequence, of the printhead 312, of the print media loading or feeding and/or the platen 307 position. In an example, the controller 350 resides in an external processing unit 330. The PPS detector or the print carriage may comprise a wireless communication module 320 to transmit the measurements to a corresponding wireless communication module 325 of external processing unit 330. The external processing unit 330 may then identify any print media deformation and apply a corrective function or routine to the printhead 312, to the print media 305 and/or to the platen 307.

Figure 4:
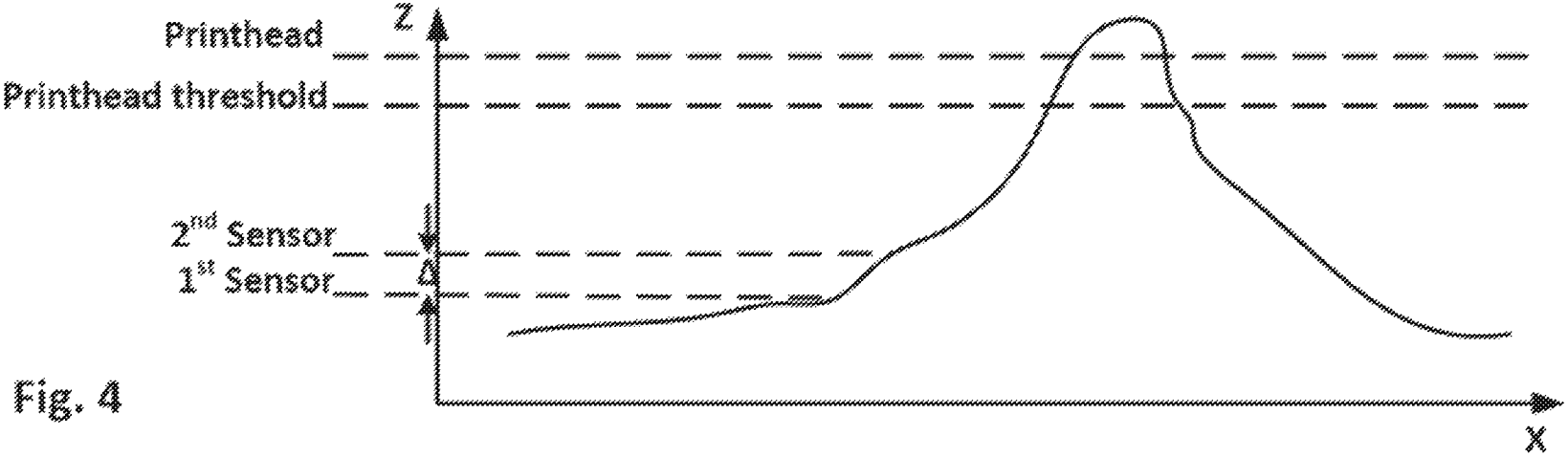
FIG. 4 schematically illustrates PPS measurements associated to print media wrinkling deformation detection.

FIG. 4 schematically illustrates PPS measurements associated to print media deformation detection due to print media wrinkling. When a PPS detector passes over a print media the PPS detector may perform various PPS measurements. For example, when the PPS detector moves in a direction X, it may measure PPS along the direction X. It may then compare difference A between successive PPS measurements to detect a wrinkling. For example, a difference A between a first sensor PPS measurement and a successive second sensor PPS measurement may provide a difference A below a predetermined threshold, i.e. within an acceptable wrinkling range. The two sensor measurements may be provided by the same sensor measuring different points at different times or by different sensors measuring different points at the same time. However, a second pair of successive sensor measurements may provide a difference A that may exceed a predetermined threshold. This may be an indirect measurement of a steep deformation in a direction Z, indicative of a wrinkling deformation. If such wrinkling is not addressed then the print media may reach and exceed a printhead threshold height (a safety limit that may trigger a print error) or even contact and crash with the printhead if it reaches a printhead height. Thus, if PPS detector detects early a steep deformation indicative of wrinkling by measuring difference A between successive PPS measurements, then a corrective function may take place and crashing may be avoided.

Figure 5:
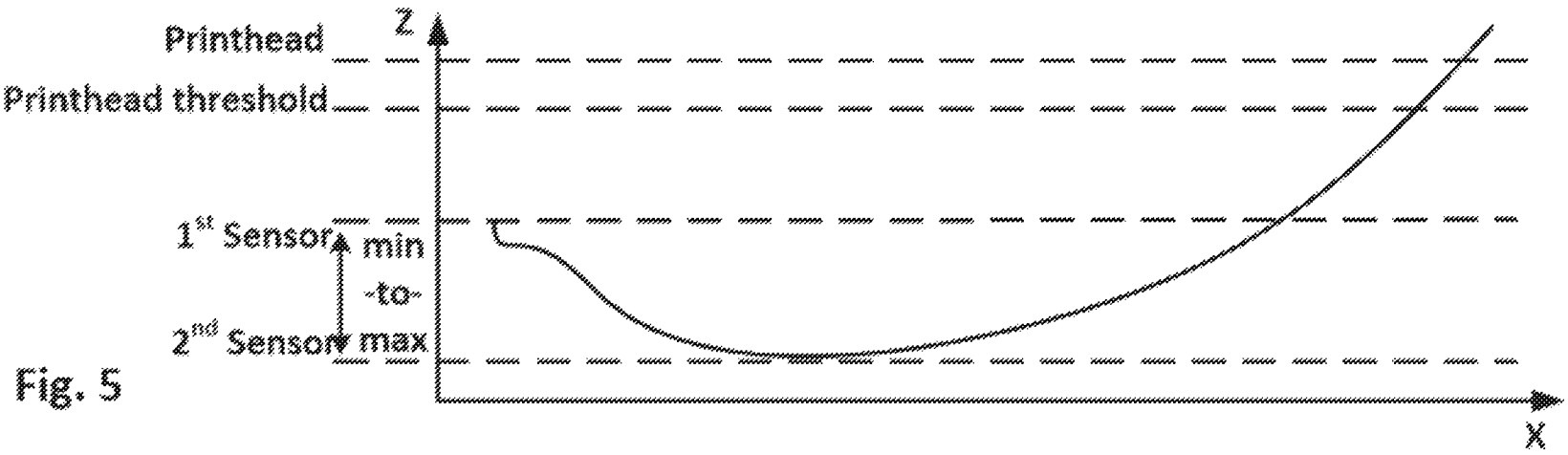
FIG. 5 schematically illustrates PPS measurements associated to print media bending deformation detection.

FIG. 5 schematically illustrates PPS measurements associated to print media bending deformation detection. When a PPS detector passes over a print media the PPS detector may perform various PPS measurements. For example, when the PPS detector moves in a direction X, it may measure PPS along the direction X. It may then compare difference min-to-max between PPS measurements to detect a bending. For example, a difference min-to-max between a first sensor PPS measurement and a second sensor PPS measurement may provide a difference min-to-max above a predetermined threshold, i.e. within an unacceptable bending range. For detecting bending the PPS measurements may not be successive as bending may be slowly forming along the direction X. To detect such slow forming bending, a maximum PPS value may be stored and updated each time a new maximum PPS is measured and, likewise, a minimum PPS value may be stored and updated each time a new minimum PPS is measured. By comparing the maximum and minimum values at any given moment a difference min-to-max associated with bending may be calculated. If the difference min-to-max exceeds a threshold then bending may be identified. If such bending is not addressed then the print media may reach and exceed a printhead threshold height (a safety limit that may trigger a print error) or even contact and crash with the printhead if it reaches a printhead height. Thus, if PPS detector detects early a bending deformation by measuring difference min-to-max between PPS measurements, then a corrective function may take place.

Figure 6:
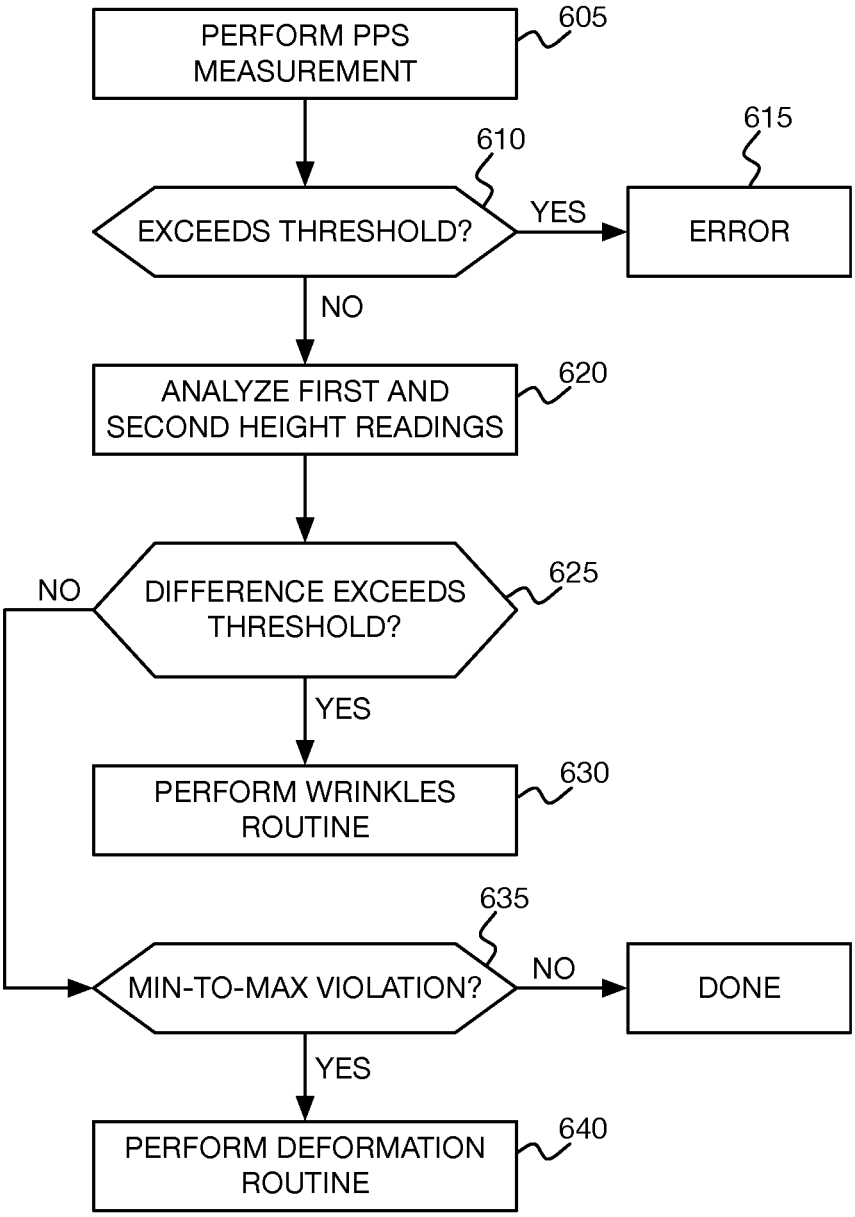
FIG. 6 schematically illustrates a flow diagram of a method of correcting media deformations, according to an example.

FIG. 6 schematically illustrates a flow diagram of a method of correcting media deformations, according to an example. In block 605, PPS measurements may be performed. In block 610, measured PPS may be compared with a printhead threshold. If the PPS measured exceeds a printhead threshold then, in block 615, a system error may occur. If the PPS measured does not exceed the printhead threshold, then, in block 620, first and second height readings are analyzed. In block 625, the difference between first and second successive readings is calculated and if it exceeds a threshold A, then a wrinkles routine 630 may be performed. The wrinkles routine 630 may include a process to recover the wrinkle. As the media advance process may cause the wrinkle to appear, by modifying or temporarily reversing the media advance parameters it may be possible to reverse the wrinkle effect. For example, by reducing a vacuum of the printzone and by moving the media forward and backwards in a reciprocating motion the wrinkle effect may be mitigated and flatness may be recovered. When the wrinkles recovery routine has been executed, the PPS detector may return to the previous position and scan again the height profile to verify if the wrinkle has been mitigated. If the wrinkle has not disappeared, then an additional process may be performed. For example, the speed of the carriage may be reduced. Then the surface over the printzone may be scanned with the PPS detector to evaluate if the winkle could cause a crash condition. If the wrinkle is too high, exceeding the printhead threshold height, then the printing stops. Otherwise, printing may continue.

If the difference between successive PPS detector readings does not exceed the threshold A, then, in block 635, it may be calculated if a min-to-max violation is taking place. That is, if the difference of any two sensor readings, i.e. PPS measurements, exceeds a predefined min-to-max threshold. In such case, in block 640, a bending deformation routine 640 may be performed. As the print media bending deformation may be caused by drying and/or curing of the print media, the bending deformation routine 640 may include measures to mitigate the effects of drying and/or curing by changing drying and curing settings for the print media.

For example, the deformation routine 640 may reduce the drying and curing temperature, while reducing the printing speed, which may allow curing of the printing fluids, e.g. latex inks, using lower temperatures. Another mitigation effect may be to increase the vacuum in the printzone to maintain the media closer to the printzone, and try to move the media forward and backwards in a reciprocating motion until the effect is achieved.

Then, in a similar manner as the one discussed for the wrinkles routine 630, the surface over the printzone may be scanned with the PPS detector to evaluate if the deformation may cause a crash condition. If the bending is too high, exceeding the printhead threshold height, then the printing stops. Otherwise, printing may continue.

The proposed preventive method and apparatus allows avoiding printing errors, carriage crashes and crash conditions while printing on rigid or flexible print media, e.g. in latex printers. By preventively identifying print media deformation and by applying corrective functions, the print quality may be improved and be consistent across a print job. In some cases such improvement may be based on the corrective function itself (e.g. when a firing delay is performed). In other cases such improvement may be indirect, and may be performed by mitigating the deformation of the print media (e.g. by removing a wrinkle). The application of the corrective function may further increase the up time of the printers and may increase robustness and reliability of the printing in unattended modes). The application of the corrective function may increase printer productivity and level of satisfaction with less user intervention as less printing errors may occur.

The preceding description has been presented to illustrate and describe certain examples. Different sets of examples have been described; these may be applied individually or in combination, sometimes with a synergetic effect. This description is not intended to be exhaustive or to limit these principles to any precise form disclosed. Many modifications and variations are possible in light of the above teaching. It is to be understood that any feature described in relation to any one example may be used alone, or in combination with other features described, and may also be used in combination with any features of any other of the examples, or any combination of any other of the examples.

What is claimed is:

1. A method of dynamically preventing printing errors caused by a media deformation, comprising:

measuring a pen to print media space (PPS) distance;

identifying a media deformation in response to measuring the PPS distance;

identifying a corrective function in response to identifying the media deformation, as reducing a drying and/or curing temperature of the print media or as performing a reciprocating movement of the print media; and performing the corrective function identified.

2. The method of claim 1, wherein measuring the PPS distance comprises measuring the PPS distance while a print job is performed.

3. The method of claim 1, wherein identifying the media deformation comprises identifying a media thickness variation.

4. The method of claim 1, wherein identifying the media deformation comprises identifying a media bending.

5. The method of claim 1, wherein identifying the media deformation comprises identifying wrinkles in the media.

6. The method of claim 1, wherein performing the corrective function comprises reducing the drying temperature of the print media.

7. The method of claim 1, wherein performing the corrective function comprises reducing the curing temperature of the print media.

8. The method of claim 1, wherein performing the corrective function comprises reducing the drying and/or curing temperature of the print media.

9. The method of claim 1, wherein performing the corrective function comprises performing the reciprocating movement of the print media.

10. A printing system comprising:

a printhead;

a print media advancing mechanism to advance print media on a platen;

a PPS sensor to measure distances between the printhead and the print media;

a controller to identify a media deformation in view of the measured distances and to perform a corrective function in response to identification of the media deformation, wherein the corrective function comprises reducing a drying and/or curing temperature of the print media.

11. The printing system of claim 10, wherein the PPS sensor is to measure the distances between the printhead and the print media while a print job is performed.

12. The printing system of claim 10, wherein the media deformation comprises a media thickness variation.

13. The printing system of claim 10, wherein the media deformation comprises a comprises a media bending.

14. The printing system of claim 10, wherein the media deformation comprises wrinkles in the media.

15. The printing system of claim 10, wherein the corrective function comprises reducing the drying temperature of the print media.

16. The printing system of claim 10, wherein the corrective function comprises reducing the curing temperature of the print media.

17. A printing system comprising:

a printhead;

a print media advancing mechanism to advance print media on a platen;

a PPS sensor to measure distances between the printhead and the print media;

a controller to identify a media deformation in view of the measured distances and to perform a corrective function in response to identification of the media deformation, wherein the corrective function comprises performing a reciprocating movement of the print media.

18. The printing system of claim 17, wherein the PPS sensor is to measure the distances between the printhead and the print media while a print job is performed.

19. The printing system of claim 17, wherein the media deformation comprises a media thickness variation.

20. The printing system of claim 17, wherein the media deformation comprises a comprises identifying a media bending or wrinkles in the media.

* * * * *